US011262052B2

(12) United States Patent
Diccianni

(10) Patent No.: US 11,262,052 B2
(45) Date of Patent: Mar. 1, 2022

(54) LIGHT MOUNTING SYSTEM

(71) Applicant: Laminar Flow, Inc., Ivyland, PA (US)

(72) Inventor: Eric Diccianni, North Wales, PA (US)

(73) Assignee: LAMINAR FLOW, INC., Ivyland, PA (US)

( * ) Notice: Subject to any disclaimer, the term of this patent is extended or adjusted under 35 U.S.C. 154(b) by 0 days.

(21) Appl. No.: 16/794,997

(22) Filed: Feb. 19, 2020

(65) Prior Publication Data

US 2021/0254814 A1 Aug. 19, 2021

(51) Int. Cl.

| | |
|---|---|
| ***F21S 8/00*** | (2006.01) |
| ***F21V 21/04*** | (2006.01) |
| ***F21V 33/00*** | (2006.01) |
| ***F24F 13/078*** | (2006.01) |
| ***E04B 9/02*** | (2006.01) |

(52) U.S. Cl.

CPC ..... *F21V 21/04* (2013.01); *E04B 9/02* (2013.01); *F21V 33/0088* (2013.01); *F24F 13/078* (2013.01)

(58) Field of Classification Search

CPC ..... F24F 13/078; F24F 13/28; F24F 3/167; F24F 8/10; E04B 9/02; F21V 33/0088; F21V 21/04; F21Y 2103/00; F21Y 2113/00; B60Q 3/43; B60Q 2500/20; B61D 29/00; F21S 2/005; F21S 4/20; F21S 8/04; F21S 8/06; B01D 46/10; B01D 2271/02; B01D 46/0005

See application file for complete search history.

(56) References Cited

U.S. PATENT DOCUMENTS 2,264,141 A * 11/1941 Nemeroff ..... F21V 17/00 362/224
4,671,811 A * 6/1987 Cadwell, Jr. ..... B01D 46/10 52/506.06
4,883,511 A * 11/1989 Gustin ..... B01D 46/002 55/355
5,171,084 A * 12/1992 Burkarth ..... F21V 29/83 362/480

(Continued)

OTHER PUBLICATIONS

Laminar Flow Inc., Standard Partially Recessed Light Fixture, 1 page, Mar. 19, 2013.

*Primary Examiner* — Omar Rojas Cadima
(74) *Attorney, Agent, or Firm* — Panitch Schwarze Belisario & Nadel LLP

(57) ABSTRACT

A light fixture, for a ceiling plenum system defining an upstream space and a downstream space, includes a light-fixture base defining a light-fixture axis. First and second side walls extend toward the downstream space and are sealingly attached to the base plate and to first and second end plates. First and second legs are sealingly attached to the light-fixture base by one of a first-leg continuously welded joint and a first-leg monolithic connection. A downstream end of each leg forms a knife portion. First and second gas filters each comprise an orthogonal gas-filter frame defining an interior perimeter and an exterior perimeter. A trough with sealant affixed therein is sealingly attached to and surrounds a portion of the exterior perimeter. A trough opening faces the downstream space, with the knife portions penetrating surfaces of the sealant, forming a seal between the light-fixture base and each gas filter.

39 Claims, 8 Drawing Sheets

(56) References Cited

U.S. PATENT DOCUMENTS

| | | | | |
|---|---|---|---|---|
| 5,540,028 | A * | 7/1996 | Scott | B01D 46/0005 52/302.1 |
| 2017/0304758 | A1 * | 10/2017 | Dinakaran | B01D 46/10 |

* cited by examiner

LIGHT MOUNTING SYSTEM

BACKGROUND

The present disclosure relates generally to clean rooms and more particularly to a light mounting system that may be useful for a clean room. Certain embodiments of the present disclosure relate more particularly to a light fixture for a ceiling plenum system for a clean room.

SUMMARY OF THE DISCLOSURE

Briefly stated, an example of a light fixture is disclosed for a ceiling plenum system defining an upstream space and a downstream space including a clean room. The light fixture may comprise a light-fixture base defining a light-fixture axis and may include a base plate. A first side wall may extend toward the downstream space and may be sealingly attached to the base plate; a second side wall may extend toward the downstream space and may be sealingly attached to the base plate. A first end plate at a first end may be sealingly attached to the base plate and the first and second side walls; a second end plate at a second end may be sealingly attached to the base plate and the first and second side walls. A first leg may extend outwardly from the light-fixture base and may be sealingly attached to the light-fixture base by one of a first-leg continuously welded joint and a first-leg monolithic connection. A downstream end of the first leg may form a first-leg knife portion which is spaced from the light-fixture base. The first leg may extend from the first end to the second end of the light-fixture base. A second leg may extend outwardly from the light-fixture base and may be sealingly attached to the light-fixture base by one of a second-leg continuously welded joint and a monolithic connection. A downstream end of the second leg may form a second-leg knife portion which is spaced from the light fixture base, and the second leg may extend from the first end to the second end of the light-fixture base. A first gas filter may comprise an orthogonal first gas-filter frame defining an interior perimeter and an exterior perimeter. The first gas-filter frame may have a trough sealingly attached to and surrounding at least a portion of the exterior perimeter. The trough may have a trough opening facing toward the upstream space. The trough may have a sealant affixed therein, with the first-leg knife portion penetrating an outer surface of the sealant to form a seal between the light-fixture base and the first gas filter.

A second gas filter may comprise an orthogonal second gas-filter frame defining an interior perimeter and an exterior perimeter. The second gas-filter frame may have a trough sealingly attached to and surrounding at least a portion of the exterior perimeter. The trough of the second gas filter may have a trough opening facing toward the upstream space. The trough of the second gas filter may have a sealant affixed therein, with the second-leg knife portion penetrating an outer surface of the sealant in the second gas filter to form a seal between the light-fixture base and the second gas filter.

In certain embodiments, the first leg and the first-leg knife portion may be formed of a single body and may be separated by a first-leg-knife-portion transition region including one of an angled portion or a curved portion; and the second leg and the second-leg knife portion may be formed of a single body and may be separated by a second-leg-knife-portion transition region including one of an angled portion or a curved portion.

In certain embodiments, the light fixture may comprise a light channel extending parallel to the light-fixture axis and may be secured to the light-fixture base without creating an unfiltered gas path between the ceiling plenum and the clean room. A first light socket may be secured to the light channel, and a first light source may be mechanically secured and electrically connected to an electrical supply wiring by the first light socket. In certain embodiments, the light channel may include a second light socket, and the first and second light sockets may cooperate to connect the first light source electrically to the electrical supply wiring. In certain embodiments, the light channel may include a second light socket, and the first and second light sockets may cooperate to connect the light source mechanically to the base plate.

In certain embodiments, the light fixture may comprise a light-fixture cover extending along the first and second legs of the light-fixture base. The light-fixture cover may be secured to the light-fixture base, with the light channel being secured to the light-fixture cover and thereby being secured to the light-fixture base.

In certain embodiments, the light fixture may comprise a light-fixture cover extending along the first and second legs of the light-fixture base, with the light-fixture cover being welded to the light-fixture base. The light channel may be secured to the light-fixture cover and thereby may be secured to the light-fixture base.

In certain embodiments, the light fixture may comprise a light diffuser having a downstream diffusing surface disposed toward the downstream space with respect to the light source. The light diffuser may be secured to the light fixture without an aperture creating an unfiltered gas path between the ceiling plenum and the clean room. The light diffuser may be secured to the light fixture via a snap fitting.

In certain embodiments, the light fixture may comprise a first lens-end cap and a second lens-end cap disposed at opposite ends of the light source, with the first lens-end cap and the second lens-end cap being adapted and positioned to block a portion of light from the light source from entering the clean room.

In certain embodiments, the light fixture may comprise a plenum frame surrounding the light fixture base, the first gas filter, and the second gas filter.

In certain embodiments, the light fixture may comprise a threaded fastener having a head and a threaded portion, with the threaded fastener being secured to the light-fixture cover, the head being oriented generally toward the upstream space and the threaded portion extending distally and generally toward the downstream space. A securing tab may be engaged with the threaded portion, and a nut may be engaged with the threaded portion and located distally with respect to the securing tab. The securing tab may be rotatable about the threaded portion and may be securable via the nut and thereby may selectively secure the first gas filter to the light-fixture module.

In certain embodiments, a plenum frame may be secured to a building structure and may be continuously welded to at least one of a first end member, a second end member, and the light fixture.

In certain embodiments, a wiring aperture may have a sealed wiring conduit sealingly engaged with the light fixture, and the electrical supply wiring may pass through and may be sealed within the sealed wiring conduit. In certain embodiments, the sealed wiring conduit may be continuously welded to the light-fixture body.

In certain embodiments, the light fixture may comprise a first sealed junction box, with the electrical supply wiring being joined to an outside electrical supply wiring within the first sealed junction box, and the sealed wiring conduit being sealingly engaged with the first sealed junction box.

In certain embodiments, the light fixture may comprise a first sealed junction box, with the electrical supply wiring being joined to an outside electrical supply wiring within the first sealed junction box, and the sealed wiring conduit being sealingly engaged with the first sealed junction box. A second sealed junction box may be included, with the intermediate electrical supply wiring being joined to an outside electrical supply wiring within the second sealed junction box. A second sealed wiring conduit may be sealingly engaged with and may extend between and first sealed junction box and the second sealed junction box, with the intermediate electrical supply wiring passing through and sealed within the second sealed wiring conduit.

BRIEF DESCRIPTION OF THE SEVERAL VIEWS OF THE DRAWINGS

The foregoing summary, as well as the following detailed description of examples of systems and devices according to the invention, will be better understood when read in conjunction with the appended drawings. For the purpose of illustrating the invention, there are shown in the drawings an embodiment or embodiments which is or are presently preferred. It should be understood, however, that the invention is not limited to the precise arrangements and instrumentalities shown. In the drawings.

DETAILED DESCRIPTION

Figure 1:
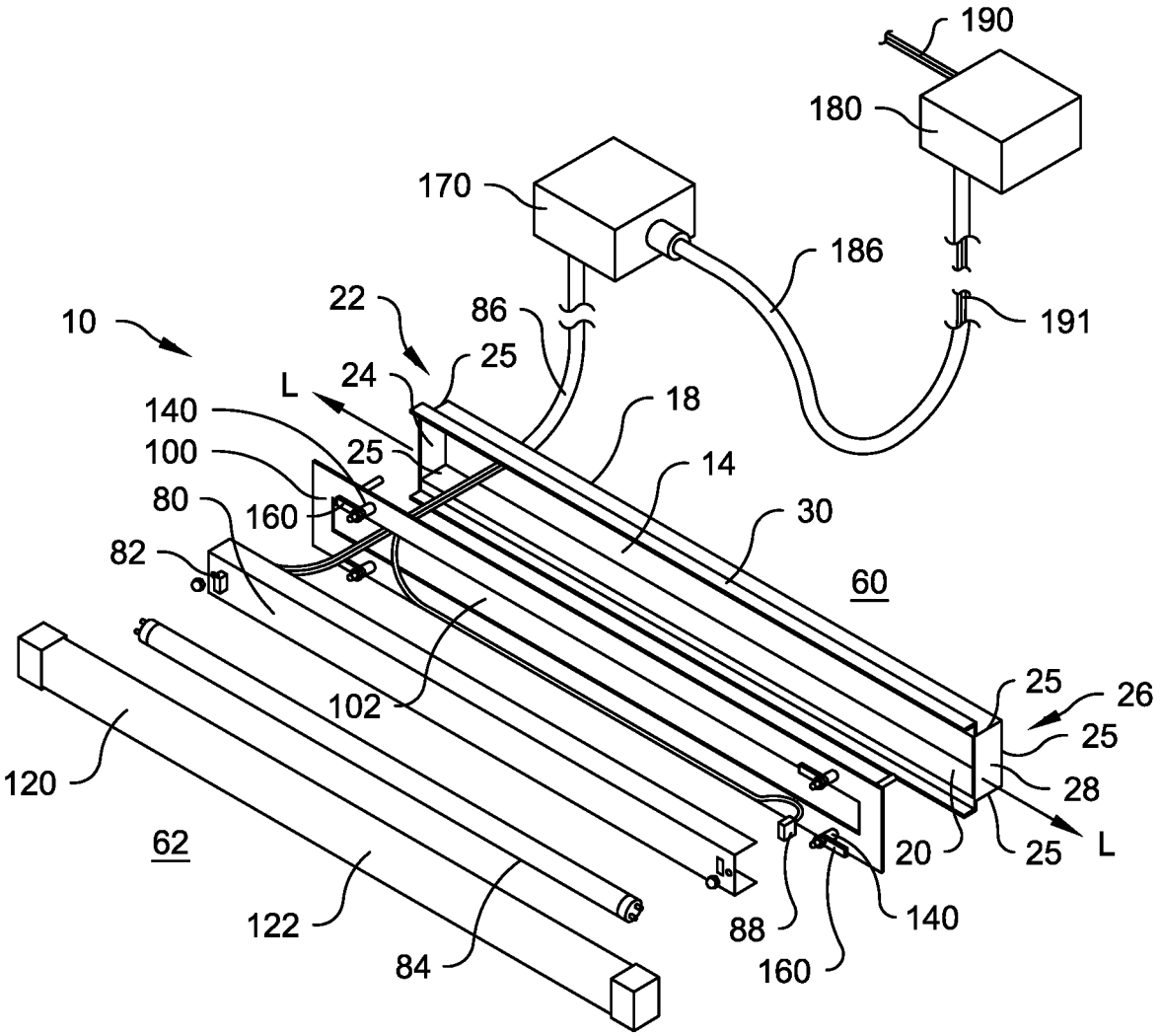
FIG. 1 is a right lower exploded perspective view of an embodiment of a light-fixture base for a light fixture according to an embodiment of the invention.

Certain terminology is used in the following description for convenience only and is not limiting. The words "right," "left," "lower," and "upper" designate directions in the drawings to which reference is made. The words "inner" and "outer" refer to directions toward and away from, respectively, the geometric center of the device and designated parts thereof. Unless specifically set forth herein, the terms "a," "an," and "the" are not limited to one element but instead should be read as meaning "at least one." "At least one" may occasionally be used for clarity or readability, but such use does not change the interpretation of "a," "an," and "the." The terminology includes the words noted above, derivatives thereof and words of similar import. Moreover, the singular includes the plural, and vice versa, unless the context clearly indicates otherwise. Various components are described in terms of a single component; however, the illustrated embodiment, or other embodiments not illustrated, may include two or more of the same component, as illustrated in the drawings or noted in the specification, or as otherwise would be understood by a person of skill in the art. Various components may be described as being secured against movement, relative movement, or flexing; these references do not contemplate the absolute elimination of all movement or flexing. Instead, these references include restriction or movement of flexing sufficient to alter the functionality of the component or components in operative relation therewith. References to a component extending, moving, or flexing in a particular direction refer to the component extending, moving, or flexing at least partially in the particular direction; an extension, movement, or flexion that includes any component of movement in the particular direction is included. For each joint described herein as being formed by a monolithic connection, connected elements are formed seamlessly from a single piece of metal or other material, preferably a sheet or plate thereof, bent or otherwise formed into the desired shape.

Figure 3:
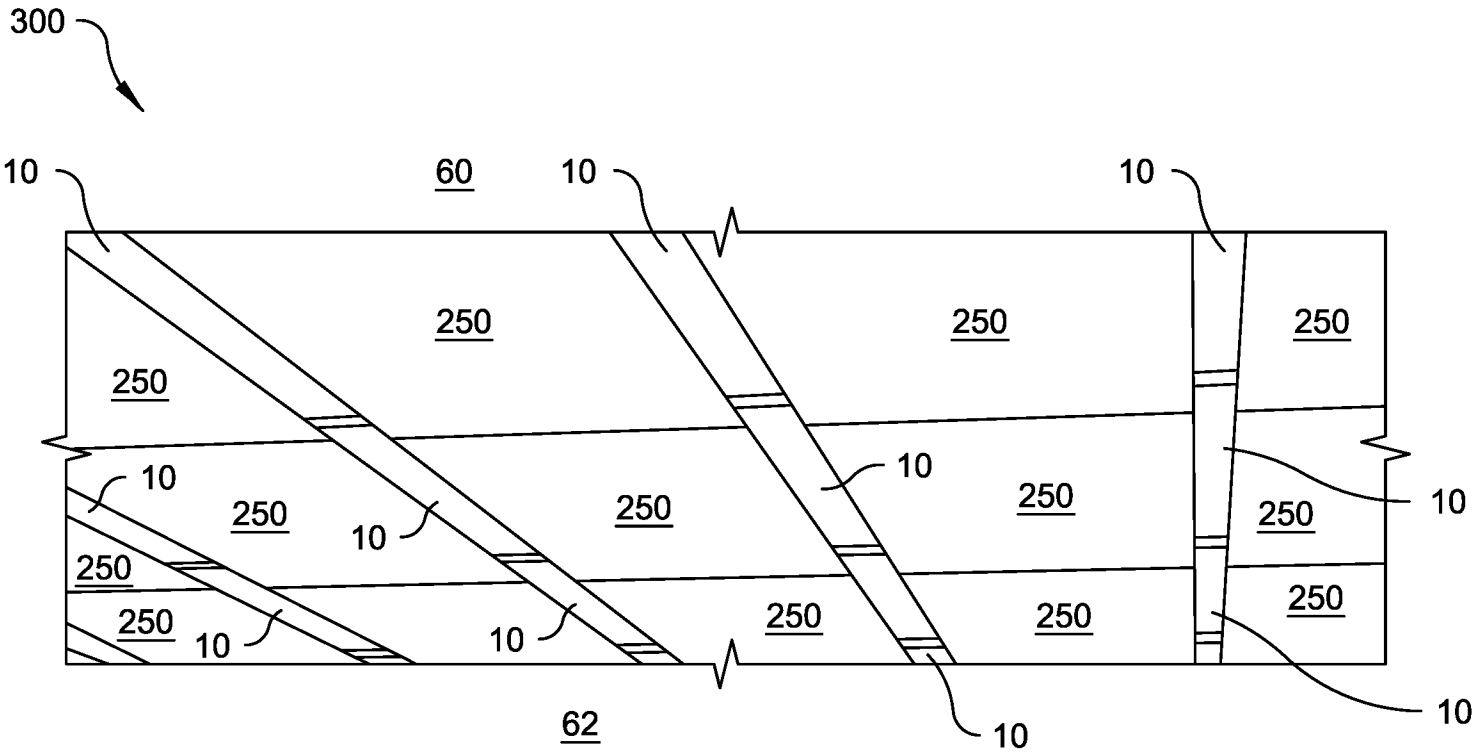
FIG. 3 is a lower partial perspective view of an embodiment of a ceiling plenum system for a clean room.
Figure 4:
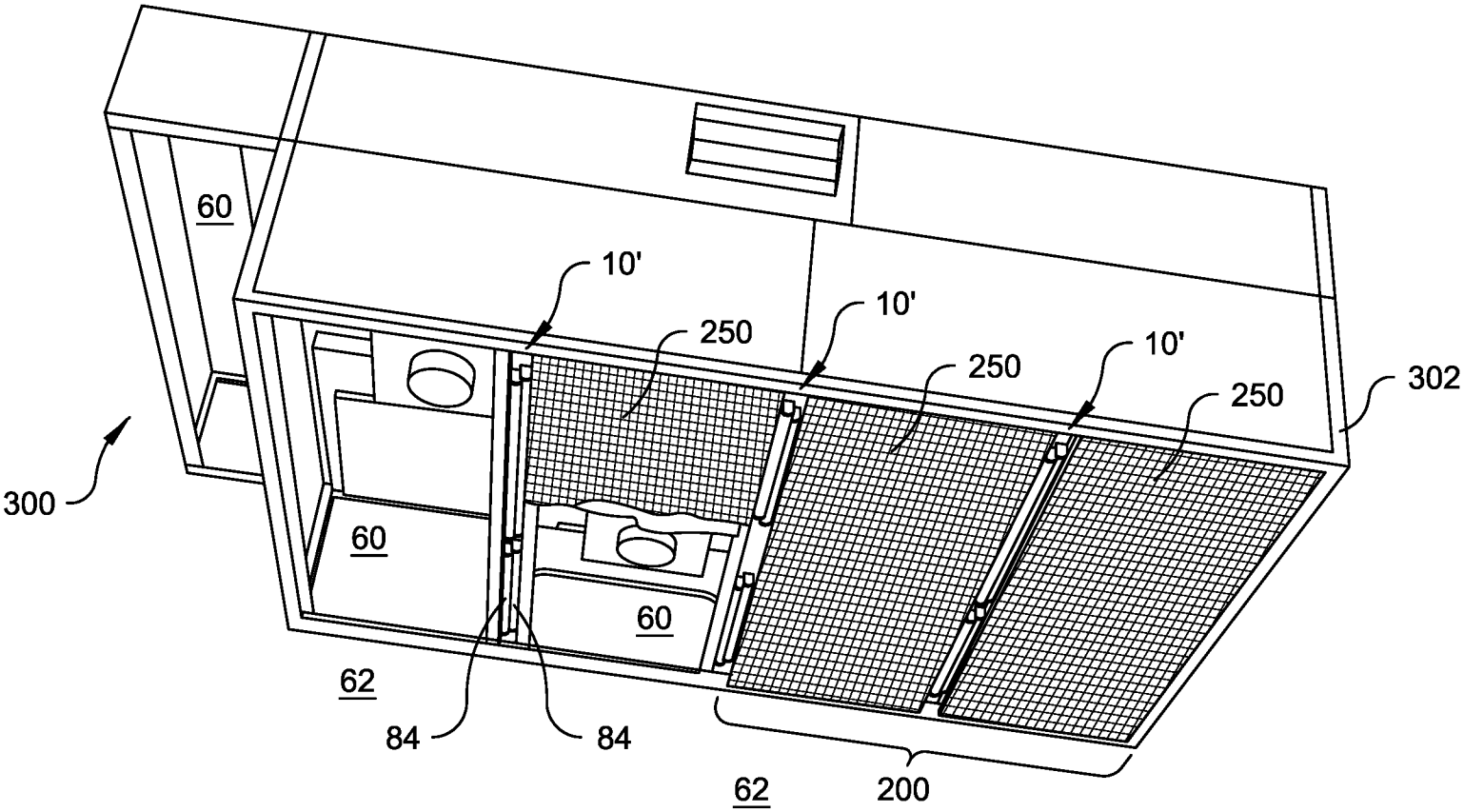
FIG. 4 is a lower perspective partially cut away view of an embodiment of a ceiling plenum system.

In one aspect, referring to FIGS. 1-5, 8, and 9, a light-fixture base 10 may be provided for a light fixture 200 for a ceiling plenum 300. (The light fixture 200 and the ceiling plenum 300 are discussed below.) The light-fixture base 10 may define a light-fixture axis L (FIGS. 1 and 2) and may include a base plate 14. A first side wall 18 may extend toward a downstream space 62 and may be sealingly attached to the base plate 14. The downstream space 62 may include a clean room, which may be any room in which it is desired to provide a controlled atmosphere via the ceiling plenum 300. As shown in FIGS. 3 and 4, a ceiling plenum 300 is formed by a grid of light fixtures (reference numerals 200 omitted from FIG. 3 for clarify) including light-fixture bases 10 disposed between gas filters 250, which preferably are assembled in a rectangular grid to form a rectangular ceiling or ceiling portion of a rectangular or generally rectangular room. The light fixtures 200 and the light-fixture bases 10 and gas filters 250 thereof may be sealingly assembled so that all or substantially all gas passing from the upstream space 60 to the downstream space 62 passes through one of the gas filters 250, with no or substantially no unfiltered gas path from the upstream space 60 to the downstream space 62. Thus the ceiling plenum 300 may be used to provide a filtered atmosphere to the downstream space 62 and to any clean room located in the downstream space.

Referring again to FIGS. 1-5, 8, and 9, a second side wall 20 may extend toward the downstream space 62 and may be sealingly attached to the base plate 14. A first end plate 24 at a first end 22 may be sealingly attached to each of the base plate 14 and the first and second side walls 18, 20 by way of a continuously welded joint 25 or a monolithic connection. A second end plate 28 at a second end 26 may be sealingly attached to each of the base plate 14 and the first and second side walls 18, 20 by way of a continuously welded joint 25 or a monolithic connection. A first leg 30 may extend outwardly from the light-fixture base 10 and may be sealingly attached to the light-fixture base 10 by one of a first-leg continuously welded joint 32 (shown in phantom in FIG. 8) and a first-leg monolithic connection 34. A downstream end of the first leg 30 may form a first-leg knife portion 36 which is spaced from the light-fixture base 10, with the first leg 30 extending from the first end 22 to the second end 26 of the light-fixture base 10, enabling the first-leg knife portion 36 to form a continuous seal extending the length of the light-fixture base 10.

A second leg 40 may extend outwardly from the light-fixture base 10 and may be sealingly attached to the light-fixture base 10 by one of a second-leg continuously welded joint 42 (shown in phantom in FIG. 8) and a second-leg monolithic connection 44. A downstream end of the second leg 40 may form a second-leg knife portion 46 which is spaced from the light-fixture base 10, with the second leg 40 extending from the first end 22 to the second end 26 of the light-fixture base 10, enabling the second-leg knife portion 46 to form a continuous seal extending the length of the light-fixture base 10.

The first leg 30 and the first-leg knife portion 36 may be formed of a single body and may be separated by a first-leg-knife-portion transition region 38 including one of an angled portion as shown, or alternatively a curved portion. The second leg 40 and the second-leg knife portion 46 may be formed of a single body and may be separated by a second-leg-knife-portion transition region 48 including one of an angled portion as shown, or alternatively a curved portion.

The light fixture 200 may comprise a light channel 80 extending parallel to the light-fixture axis L and secured to the light-fixture base 10 without creating an unfiltered gas path between the ceiling plenum and the clean room, as discussed above. A first light socket 82 may be secured to the light channel 80. A first light source, which may take the form of a light tube 84, a light bulb, or another electrically powered light source, may be mechanically secured and electrically connected to an electrical supply wiring, which may comprise electrical supply wires 87 as are known in the art, by the first light socket 82. The light channel 80 may include, and as shown includes, a second light socket 88. The first and second light sockets 82, 88 may cooperate to connect the light tube 84, or a different form of light source as is known in the art, mechanically to the electrical supply wiring. A wiring aperture 85 may have a sealed wiring conduit 86 passing through and sealingly engaged with the light-fixture base 10, and the electrical supply wires 87 may pass through and may be sealed within the sealed wiring conduit 86 by a conduit sealant 86*a* (see FIG. 1B), which may comprise a rubber, foam, solid plastic, or cellular sealant and which may occupy the volume of the conduit 86 to the extent that the volume is not occupied by the electrical supply wires 87. This configuration may aid in reducing or eliminating air leakage between the upstream space 60 and the downstream space 62.

Figure 1A:
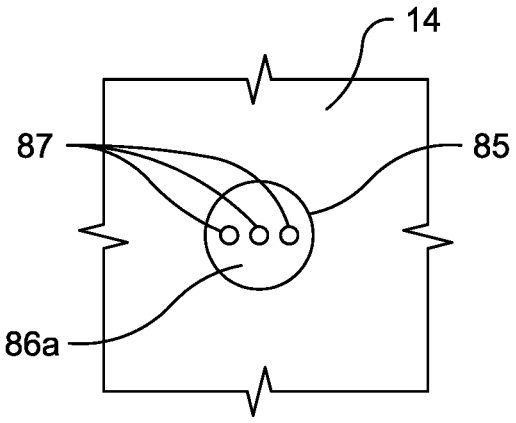
FIG. 1A is a magnified partial lower view of the light-fixture base of FIG. 1.
Figure 2A:
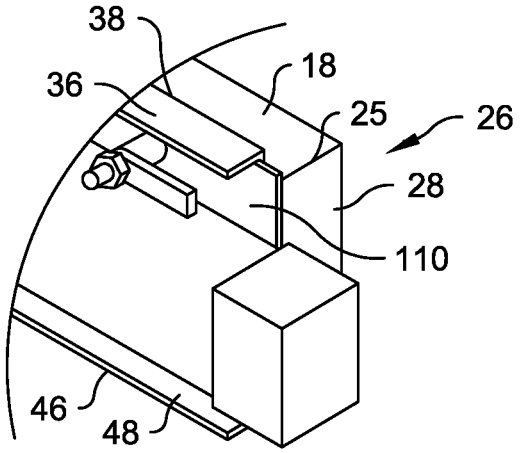
FIG. 2A is a magnified partial right lower view of the light-fixture base of FIG. 2.
Figure 2:
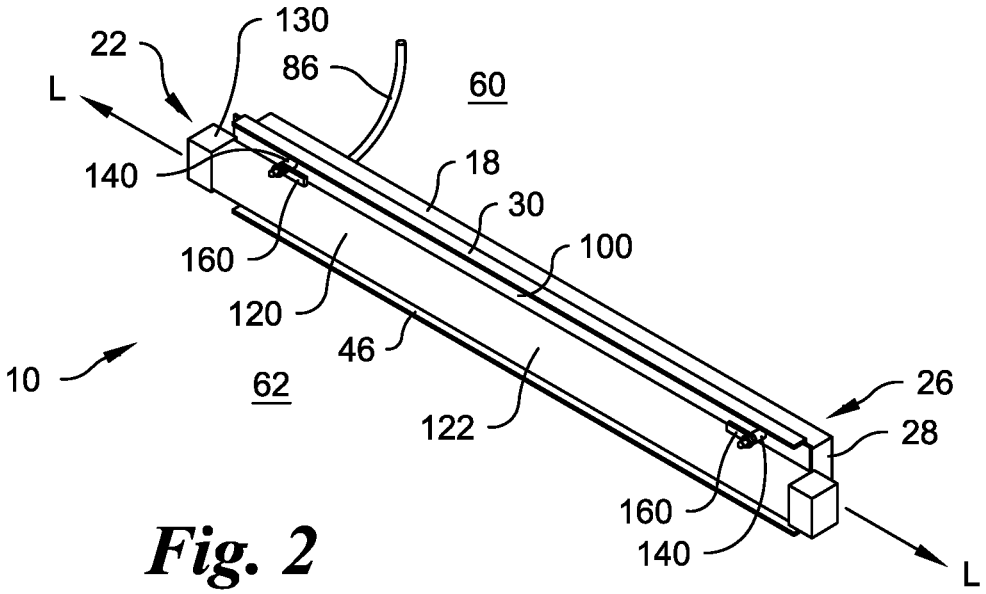
FIG. 2 is right lower perspective view of the light-fixture base of FIG. 1.

Referring to FIG. 1, a first sealed junction box 170, and a second sealed junction box 180 may be included in the light fixture 200 (FIGS. 4 and 5) and may be connected to the light-fixture base 10. The electrical supply wires 87 (FIG. 1A) comprising the electrical supply wiring may be joined to an intermediate electrical supply wiring 191 within the first sealed junction box 170. The sealed wiring conduit 86 may be being sealingly engaged with the first sealed junction box 170 by, for example, being continuously welded, threadedly attached, or otherwise affixed and sealed thereto. A second sealed junction box 180 may be included, with the intermediate electrical supply 191 wiring being joined to an outside electrical supply wiring 190 within the second sealed junction box 180. A second sealed wiring conduit 186 may be sealingly engaged with and may extend between the first sealed junction box 170 and the second sealed junction box 180, with the intermediate electrical supply 191 wiring passing through and sealed within the second sealed wiring conduit 186. Alternatively, the first sealed junction box 170 and the second sealed wiring conduit 186 may be omitted, and the second sealed junction box 180 may be sealingly engaged with the sealed conduit 86, with the electrical supply wires 87 being connected to the outside electrical supply wiring 190. Further alternatively, one or more unsealed junction boxes may be substituted for the first and second sealed junction boxes 170, 180. This configuration may aid in reducing or eliminating air leakage between the upstream space 60 and the downstream space 62.

The first and second light sockets 82, 88 may cooperate to connect the light source, such as the light tube 84, mechanically to the base plate 14 by way of the light channel 80.

The light fixture 200 may comprise a light-fixture cover 100, which may be a generally rectangular plate with a generally rectangular aperture 102 therein. The light-fixture cover 100 may extend along the first and second legs 30, 40 of the light-fixture base 10. The light-fixture cover 100 may be secured to the light-fixture base 10, with the light channel 80 being secured to the light-fixture cover 100 and thereby being secured to the light-fixture base 10 and the light fixture 200. The light-fixture cover 100 may be secured to the light-fixture base 10 by a discontinuous or stitched welded joint, or by another suitable connection method that does not employ a fastener penetrating the light-fixture base or forming an unfiltered gas path between the upstream space 60 and the downstream space 62.

The light fixture 200 may comprise a light diffuser 120 having a downstream diffusing surface 122 disposed toward the downstream space 62 with respect to the light tube 84 or other light source. The light diffuser 120 may be secured to the light fixture 200 without creating an unfiltered gas path between the ceiling plenum 300 and the downstream space 62 containing the clean room. The light diffuser 122 may be formed from a flexible, translucent material such as a suitable polymer and secured to the light fixture 200 via, for example, a snap fitting, or by engaging the light diffuser 122 with lens-end caps 130 (discussed below), allowing the light diffuser to be removed for replacement of the light tube 84 or other light source without creating an unfiltered gas path between the ceiling plenum 300 and the downstream space 62, and any clean room located in the downstream space 62.

The light fixture 200 may comprise a first and a second lens-end cap 130 disposed on opposite ends of the light tube 84 or other source, with the first and second lens-end caps 130 being adapted and positioned to block a portion of light from the light tube 84 or other light source from entering the downstream space 62 and thus the clean room. The first and second lens-end caps 130 may be spaced so that the light diffuser may be flexed and inserted between the first and second lens-end caps 130 and thereby secured to the light fixture 200.

Referring to FIG. 4, the light-fixture base 10', an alternative embodiment of the light-fixture base 10, may be adapted to hold two light tubes 84 per light-fixture base 10', may be incorporated into a light fixture, an example of which is the light fixture 200 for a ceiling plenum 300 defining an upstream space 60 and a downstream space 62 including a clean room. The light fixture 200 (FIG. 4) may comprise the light-fixture base 10', a first gas filter 250, and a second gas filter 250. The light-fixture base 10, which is identical to the light-fixture base 10' other than adaptation for a second light tube 84, may be used in the ceiling plenum 300 of FIG. 4.

Figure 7:
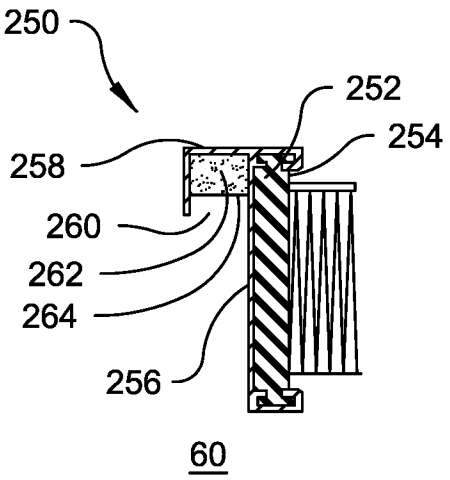
FIG. 7 is a partial sectional view of the filter of FIG. 6, take along line 7-7.
Figure 6:
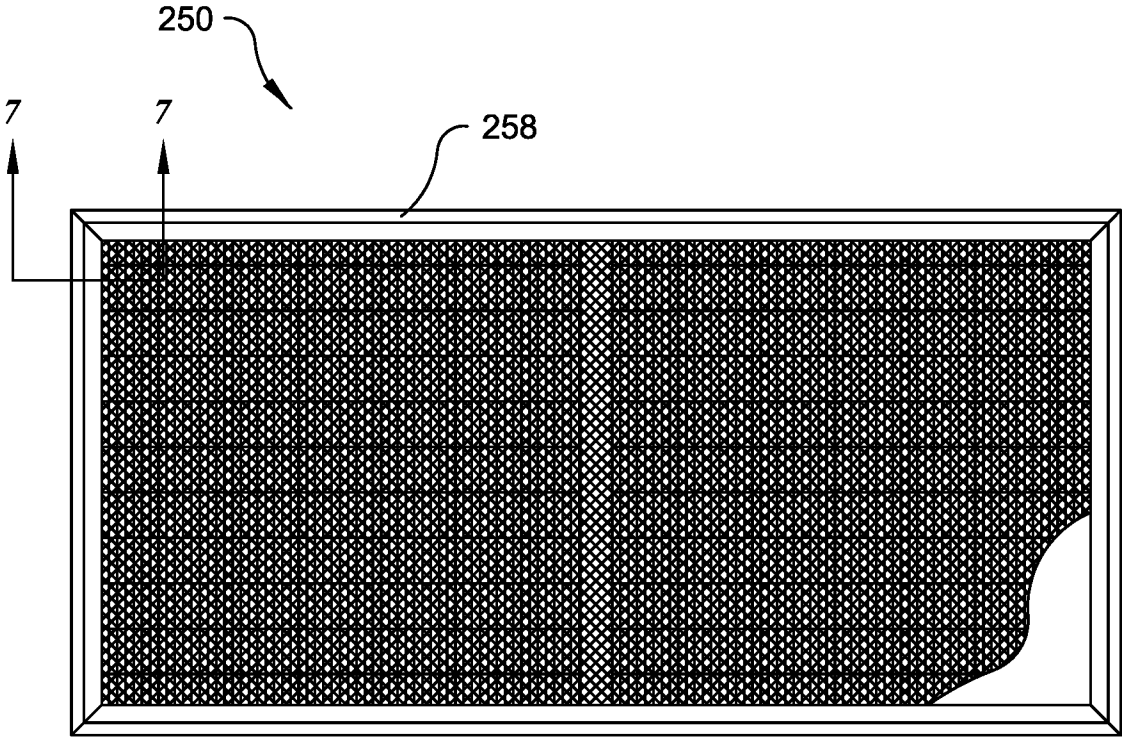
FIG. 6 is a lower elevational view of an embodiment of a gas filter for a ceiling plenum system.
Figure 8:
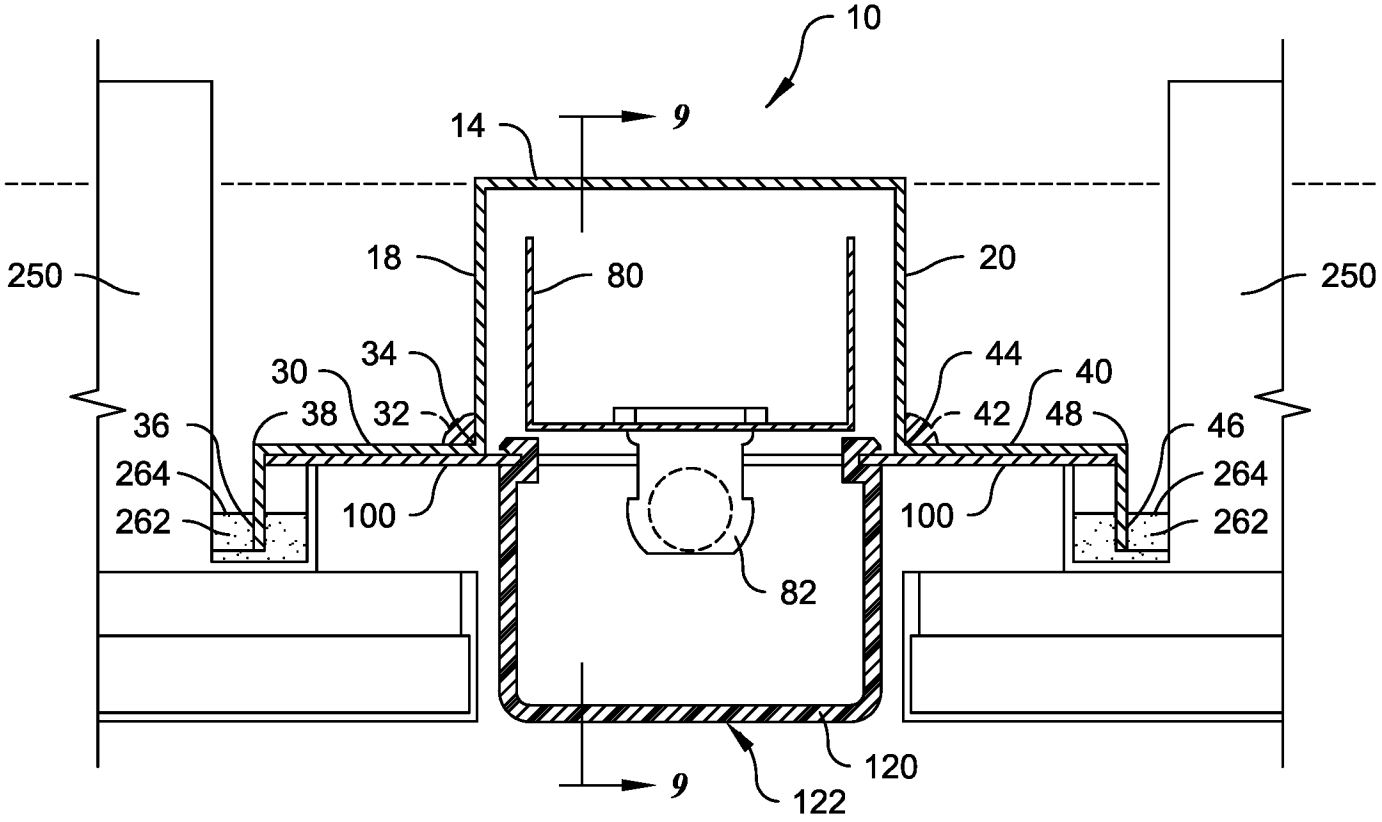
FIG. 8 is a partial sectional view of an embodiment of a ceiling plenum system, showing a light fixture and the connection thereof to two filters, with a light tube omitted for clarity.
Figure 9:
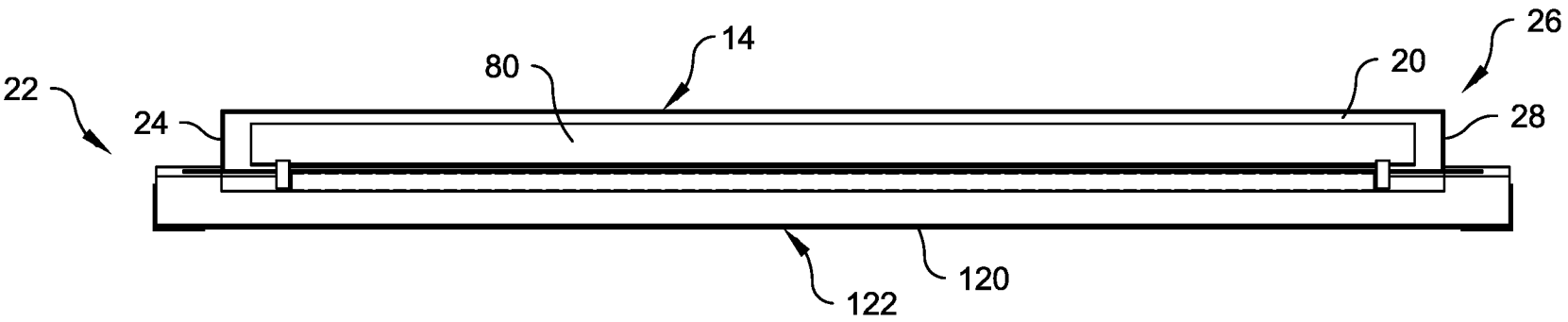
FIG. 9 is sectional view taken along line 9-9 in FIG. 8.

As shown in detail in FIGS. 6 and 7, a gas filter 250 may comprise an orthogonal first gas-filter frame 252 defining an interior perimeter 254 and an exterior perimeter 256. The first gas-filter frame 252 may have a trough 258 sealingly attached to and surrounding at least a portion of the exterior perimeter 256. The trough 258 may extend the entire length of the exterior perimeter 256 to form a sealed connection extending the entire length of the exterior perimeter 256. The trough 258 may have a trough opening 260 facing toward the upstream space 60. The trough 258 may have a sealant such as a sealing gel 262, which may have a silicone base, affixed therein. The first-leg knife portion 36 may penetrate an outer surface 264 of the sealing gel 262 to form a seal between the light-fixture base 10 and the first gas filter 250. A second gas filter 250 may comprise an orthogonal first gas-filter frame defining an interior perimeter 252 and an exterior perimeter 254. The first gas-filter frame 252 may have a trough 258 sealingly attached to and surrounding at least a portion of the exterior perimeter 256. The trough 258 may have a trough opening 260 facing toward the upstream space 60. The trough 258 may have a sealant such as a sealing gel 262 affixed therein. The second-leg knife portion 46 may penetrate an outer surface 264 of the sealing gel 262 in the second gas filter 250 to form a seal between the light-fixture base 10 and the second gas filter 250.

BRIEF DESCRIPTION OF THE SEVERAL VIEWS OF THE DRAWINGS

Figure 5:
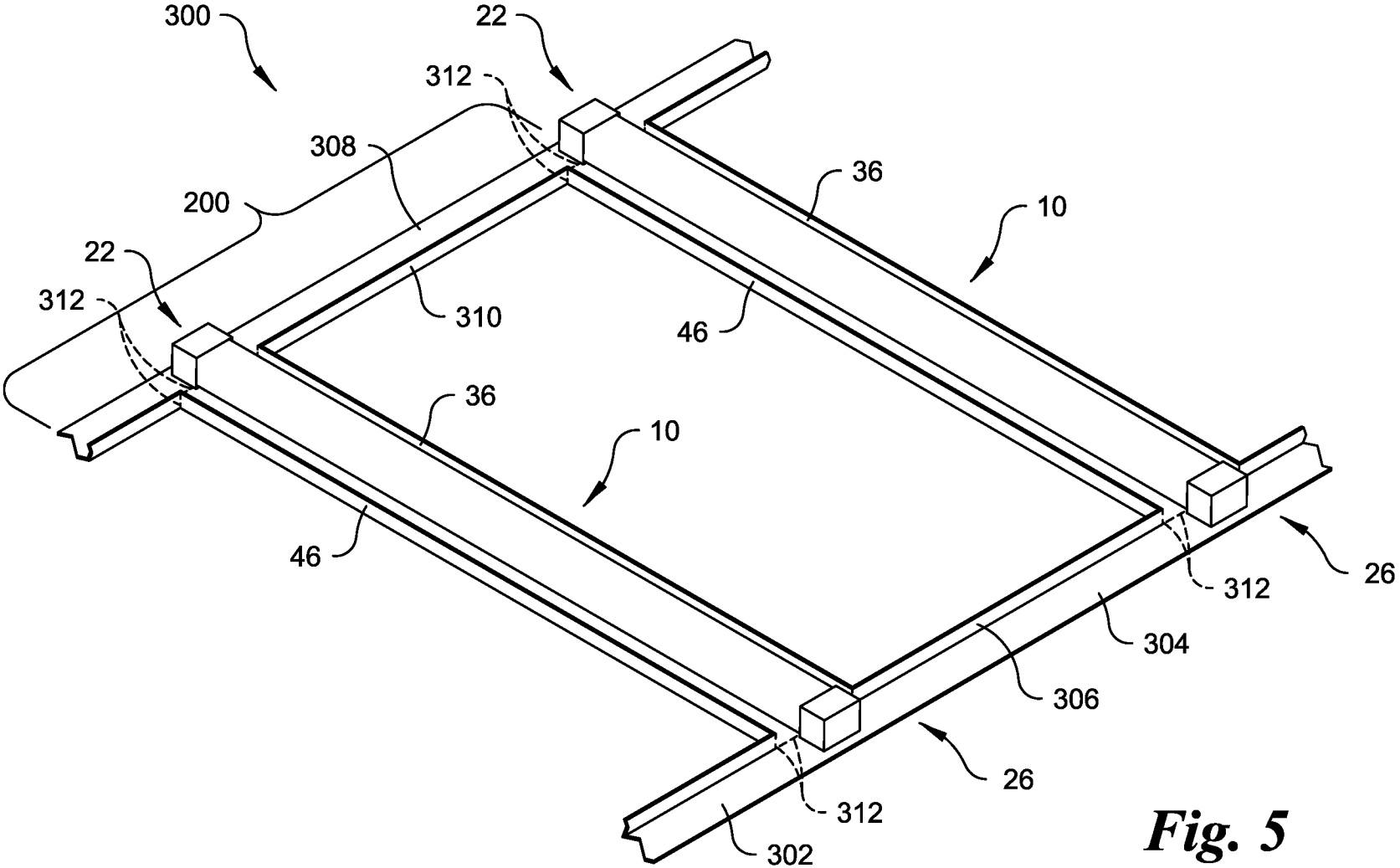
FIG. 5 lower partial inverted perspective view of an embodiment of a light fixture in a frame of a ceiling plenum system.

Referring to FIGS. 3-5, a plenum frame 302 of the ceiling plenum 300 may be secured to a building structure and preferably may be continuously welded to the building structure to seal the ceiling plenum 300 to the ceiling of a clean room. In FIG. 5, which is an inverted view of the plenum frame 302 with the gas filters 250 (FIGS. 3 and 4) omitted for clarify, the plenum frame 302 is continuously welded along welded joints 312 (shown in phantom in FIG. 5) to at least one of a first end member 304, a second end member 308, and the light fixture 200 at the first and second light-fixture ends 26, 22 of the light-fixture base 10 The first end member 304 may have a knife portion 306, and the second member 308 may have a knife portion 310, for penetrating the sealing gel 262 of the gas filters 250. The knife portions 306, 308 may be welded or otherwise sealingly connected to an adjacent first-leg knife portion 36 and second-leg knife portion 46, thereby forming a continuous composite knife portion adapted to engage the sealing gel 262 about the entire exterior perimeter 256 of each gas filter 250. The gas filter 250 may be sealed to the ceiling plenum 300 along the entire exterior perimeter 256 through engagement of the composite knife portion with the sealing gel 262, and the gas filter 250 may be removed and replaced without disturbing any other fastener or other element that extends between the upstream space 60 and the downstream space 62.

Figure 10:
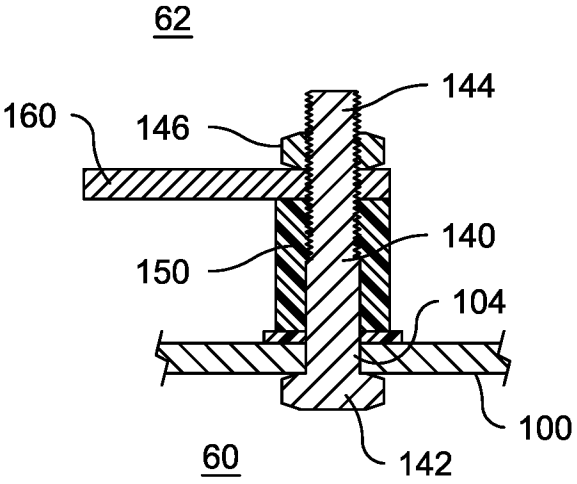
FIG. 10 is an inverted partial sectional view of the light fixture of FIG. 1.
Figure 9A:
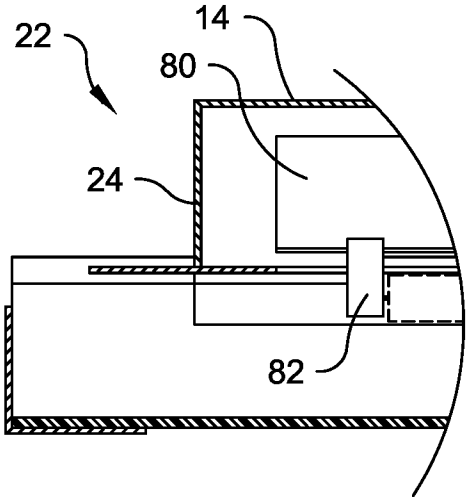
FIG. 9A is an enlarged partial view of the section of FIG. 9.

Referring to FIGS. 1 and 10, to aid in securing the gas filters 250, a threaded fastener 140 may be provided and may have a head 142 and a threaded portion 144. The threaded fastener 140 may be secured to the light-fixture cover 100 through a mounting hole 104 therein, with the head 142 being oriented generally toward the upstream space 60 and the threaded portion 144 extending distally and generally toward the downstream space 62. A securing tab 160 may be engaged with the threaded portion 144, and a nut 146 may be engaged with the threaded portion 144 and located distally with respect to the securing tab 160. A spacer 150 may be provided between the light-fixture cover 100 and the securing tab 160. The securing tab 160 may be rotatable about the threaded portion 144 and may be securable via the nut 146, and may thereby selectively secure each gas filter 250 to the light-fixture base 10 and to the plenum frame 302 of the ceiling plenum 300.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present disclosure. Moreover, aspects and features of various embodiments may be combined in a particular device; and fewer that all of the aspects and features of a particular embodiment disclosed herein may be sufficient for a functional embodiment.

I claim:

1. A light fixture for a ceiling plenum system defining an upstream space and a downstream space including a clean room, the light fixture comprising:

a light-fixture base defining a light-fixture axis and including a base plate, a first side wall extending toward the downstream space and sealingly attached to the base plate, a second side wall extending toward the downstream space and sealingly attached to the base plate, a first end plate at a first end sealingly attached to the base plate and the first and second side walls, and a second end plate at a second end sealingly attached to the base plate and the first and second side walls, wherein the light-fixture base is sealingly assembled to be impervious to gas between the upstream space and the downstream space;

a first leg extending outwardly from the light-fixture base and being sealingly attached to the light-fixture base by one of a first-leg continuously welded joint and a first-leg monolithic connection, a downstream end of the first leg forming a first-leg knife portion which is spaced from the light fixture base, the first leg extending from the first end to the second end of the light-fixture base; and a second leg extending outwardly from the light-fixture base and being sealingly attached to the light-fixture base by one of a second-leg continuously welded joint and a monolithic connection, a downstream end of the second leg forming a second-leg knife portion which is spaced from the light fixture base, the second leg extending from the first end to the second end of the light-fixture base, a first gas filter comprising an orthogonal first gas-filter frame defining an interior perimeter and an exterior perimeter, the first gas-filter frame having a trough sealingly attached to and surrounding at least a portion of the exterior perimeter, the trough having a trough opening facing toward the upstream space, the trough having a sealant affixed therein, the first-leg knife portion penetrating an outer surface of the sealant to form a seal between the light-fixture base and the first gas filter; and a second gas filter comprising an orthogonal second gas-filter frame defining an interior perimeter and an exterior perimeter, the second gas-filter frame having a trough sealingly attached to and surrounding at least a portion of the exterior perimeter, the trough of the second gas filter having a trough opening facing toward the upstream space, the trough of the second gas filter having a sealant affixed therein, the second-leg knife portion penetrating an outer surface of the sealant in the second gas filter to form a seal between the light-fixture base and the second gas filter, wherein the sealant affixed in the trough of the first gas filter engages the first-leg knife portion from the downstream space, and the sealant affixed in the trough of the second case filter engages the second-leg knife portion from the downstream space, so that the first gas filter may be removed from the ceiling plenum system and replaced from the downstream space, without disturbing any element of the ceiling plenum system in the upstream space.

2. The light fixture according to claim 1, the light fixture further comprising a light channel extending parallel to the light-fixture axis and secured to the light-fixture base without creating a gas path between the upstream space and the downstream space through the light fixture, a first light socket secured to the light channel, and a first light source mechanically secured and electrically connected to an electrical supply wiring by the first light socket.

3. The light fixture according to claim 2, wherein the light channel includes a second light socket and the first and second light sockets cooperate to connect the first light source electrically to the electrical supply wiring.

4. The light fixture according to claim 2, wherein the light channel includes a second light socket and the first and second light sockets cooperate to connect the light source mechanically to the base plate.

5. The light fixture according to claim 2, the light fixture further comprising a light-fixture cover extending along the first and second legs of the light-fixture base, the light-fixture cover being secured to the light-fixture base, with the light channel being secured to the light-fixture cover and thereby being secured to the light-fixture base.

6. The light fixture according to claim 2, the light fixture further comprising a light-fixture cover extending along the first and second legs of the light-fixture base, the light-fixture cover being welded to the light-fixture base, with the light channel being secured to the light-fixture cover and thereby being secured to the light-fixture base.

7. The light fixture according to claim 6, further comprising a light diffuser disposed toward the downstream space with respect to the light source, the light diffuser being secured to the light fixture without an aperture creating a gas path between the upstream space and the downstream space through the light fixture, wherein the light diffuser is secured to the light fixture via a snap fitting engaging the light-fixture cover.

8. The light fixture according to claim 2, further comprising a light diffuser having a downstream diffusing surface disposed toward the downstream space with respect to the light source, the light diffuser being secured to the light fixture without an aperture creating a gas path between the upstream space and the downstream space through the light fixture.

9. The light fixture according to claim 8, wherein the light diffuser is secured to the light fixture via a snap fitting.

10. The light fixture according to claim 2, further comprising a first lens-end cap and a second lens-end cap disposed on opposite ends of the light source, the first lens-end cap and the second lens-end cap being adapted and positioned to block a portion of light from the light source from entering the clean room.

11. The light fixture according to claim 2, further comprising:

a wiring aperture having a sealed wiring conduit sealingly engaged with the light-fixture base, with the electrical supply wiring passing through and sealed within the sealed wiring conduit.

12. The light fixture according to claim 11, wherein the sealed wiring conduit is continuously welded to the light-fixture body.

13. The light fixture according to claim 1 further comprising a plenum frame surrounding the light fixture base, the first gas filter and the second gas filter.

14. The light fixture according to claim 1, further comprising:

a threaded fastener having a head and a threaded portion, the threaded fastener being secured to the light-fixture cover, the head being oriented generally toward the upstream space and the threaded portion extending distally and generally toward the downstream space; a securing tab engaged with the threaded portion; and a nut engaged with the threaded portion and located distally with respect to the securing tab, the securing tab being rotatable about the threaded portion and securable via the nut and thereby selectively securing the first gas filter to the light fixture.

15. The light fixture according to claim 1, further comprising:

a plenum frame secured to a building structure and continuously welded to a first end member having a knife portion, a second end member having a knife portion, and the light fixture.

16. The light fixture according to claim 1, further comprising:

a wiring aperture having a sealed wiring conduit sealingly engaged with the light-fixture base, with an electrical supply wiring passing through and sealed within the sealed wiring conduit.

17. The light fixture according to claim 16, wherein the sealed wiring conduit is continuously welded to the light-fixture body.

18. The light fixture according to claim 16, further comprising:

a first sealed junction box, with the electrical supply wiring being joined to an outside electrical supply wiring within the first sealed junction box, and the sealed wiring conduit being sealingly engaged with the first sealed junction box.

19. The light fixture according to claim 16, further comprising:

a first sealed junction box, with the electrical supply wiring being joined to an intermediate electrical supply wiring within the first sealed junction box, and the sealed wiring conduit being sealingly engaged with the first sealed junction box;

a second sealed junction box, with the intermediate electrical supply wiring being joined to an outside electrical supply wiring within the second sealed junction box; and a second sealed wiring conduit sealingly engaged with and extending between and first sealed junction box and the second sealed junction box, with the intermediate electrical supply wiring passing through and sealed within the second sealed wiring conduit.

20. The light fixture according to claim 1, wherein the trough of the first gas filter is permanently attached to the exterior perimeter of the first gas filter, and the trough of the second gas filter is permanently attached to the exterior perimeter of the second gas filter.

21. A light fixture for a ceiling plenum system defining an upstream space and a downstream space including a clean room, the light fixture comprising:

a light-fixture base defining a light-fixture axis and including a base plate, a first side wall extending toward the downstream space and sealingly attached to the base plate, a second side wall extending toward the downstream space and sealingly attached to the base plate, a first end plate at a first end sealingly attached to the base plate and the first and second side walls, and a second end plate at a second end sealingly attached to the base plate and the first and second side walls, wherein the light-fixture base is sealingly assembled to be impervious to gas between the upstream space and the downstream space;

a first leg extending outwardly from the light-fixture base and being sealingly attached to the light-fixture base by one of a first-leg continuously welded joint and a first-leg monolithic connection, a downstream end of the first leg forming a first-leg knife portion which is spaced from the light fixture base, the first leg extending from the first end to the second end of the light-fixture base; and a second leg extending outwardly from the light-fixture base and being sealingly attached to the light-fixture base by one of a second-leg continuously welded joint and a monolithic connection, a downstream end of the second leg forming a second-leg knife portion which is spaced from the light fixture base, the second leg extending from the first end to the second end of the light-fixture base, a first gas filter comprising an orthogonal first gas-filter frame defining an interior perimeter and an exterior perimeter, the first gas-filter frame having a trough sealingly attached to and surrounding at least a portion of the exterior perimeter, the trough having a trough opening facing toward the upstream space, the trough having a sealant affixed therein, the first-leg knife portion penetrating an outer surface of the sealant to form a seal between the light-fixture base and the first gas filter; and a second gas filter comprising an orthogonal second gas-filter frame defining an interior perimeter and an exterior perimeter, the second gas-filter frame having a trough sealingly attached to and surrounding at least a portion of the exterior perimeter, the trough of the second gas filter having a trough opening facing toward the upstream space, the trough of the second gas filter having a sealant affixed therein, the second-leg knife portion penetrating an outer surface of the sealant in the second gas filter to form a seal between the light-fixture base and the second gas filter, wherein the trough of the first gas filter is permanently attached to the exterior perimeter of the first gas filter, and the trough of the second gas filter is permanently attached to the exterior perimeter of the second gas filter.

22. The light fixture according to claim 21, the light fixture further comprising a light channel extending parallel to the light-fixture axis and secured to the light-fixture base without creating a gas path between the upstream space and the downstream space through the light fixture, a first light socket secured to the light channel, and a first light source mechanically secured and electrically connected to an electrical supply wiring by the first light socket.

23. The light fixture according to claim 22, wherein the light channel includes a second light socket and the first and second light sockets cooperate to connect the first light source electrically to the electrical supply wiring.

24. The light fixture according to claim 22, wherein the light channel includes a second light socket and the first and second light sockets cooperate to connect the light source mechanically to the base plate.

25. The light fixture according to claim 22, the light fixture further comprising a light-fixture cover extending along the first and second legs of the light-fixture base, the light-fixture cover being secured to the light-fixture base, with the light channel being secured to the light-fixture cover and thereby being secured to the light-fixture base.

26. The light fixture according to claim 22, the light fixture further comprising a light-fixture cover extending along the first and second legs of the light-fixture base, the light-fixture cover being welded to the light-fixture base, with the light channel being secured to the light-fixture cover and thereby being secured to the light-fixture base.

27. The light fixture according to claim 26, further comprising a light diffuser disposed toward the downstream space with respect to the light source, the light diffuser being secured to the light fixture without an aperture creating a gas path between the upstream space and the downstream space through the light fixture, wherein the light diffuser is secured to the light fixture via a snap fitting engaging the light-fixture cover.

28. The light fixture according to claim 22, further comprising a light diffuser having a downstream diffusing surface disposed toward the downstream space with respect to the light source, the light diffuser being secured to the light fixture without an aperture creating a gas path between the upstream space and the downstream space through the light fixture.

29. The light fixture according to claim 28, wherein the light diffuser is secured to the light fixture via a snap fitting.

30. The light fixture according to claim 22, further comprising a first lens-end cap and a second lens-end cap disposed on opposite ends of the light source, the first lens-end cap and the second lens-end cap being adapted and positioned to block a portion of light from the light source from entering the clean room.

31. The light fixture according to claim 22, further comprising:

a wiring aperture having a sealed wiring conduit sealingly engaged with the light-fixture base, with the electrical supply wiring passing through and sealed within the sealed wiring conduit.

32. The light fixture according to claim 31, wherein the sealed wiring conduit is continuously welded to the light-fixture body.

33. The light fixture according to claim 21 further comprising a plenum frame surrounding the light fixture base, the first gas filter and the second gas filter.

34. The light fixture according to claim 21, further comprising:

a threaded fastener having a head and a threaded portion, the threaded fastener being secured to the light-fixture cover, the head being oriented generally toward the upstream space and the threaded portion extending distally and generally toward the downstream space; a securing tab engaged with the threaded portion; and a nut engaged with the threaded portion and located distally with respect to the securing tab, the securing tab being rotatable about the threaded portion and securable via the nut and thereby selectively securing the first gas filter to the light fixture.

35. The light fixture according to claim 21, further comprising:

a plenum frame secured to a building structure and continuously welded to a first end member having a knife portion, a second end member having a knife portion, and the light fixture.

36. The light fixture according to claim 21, further comprising:

a wiring aperture having a sealed wiring conduit sealingly engaged with the light-fixture base, with an electrical supply wiring passing through and sealed within the sealed wiring conduit.

37. The light fixture according to claim 36, wherein the sealed wiring conduit is continuously welded to the light-fixture body.

38. The light fixture according to claim 36, further comprising:

a first sealed junction box, with the electrical supply wiring being joined to an outside electrical supply wiring within the first sealed junction box, and the sealed wiring conduit being sealingly engaged with the first sealed junction box.

39. The light fixture according to claim 36, further comprising:

a first sealed junction box, with the electrical supply wiring being joined to an intermediate electrical supply wiring within the first sealed junction box, and the sealed wiring conduit being sealingly engaged with the first sealed junction box;

a second sealed junction box, with the intermediate electrical supply wiring being joined to an outside electrical supply wiring within the second sealed junction box; and a second sealed wiring conduit sealingly engaged with and extending between and first sealed junction box and the second sealed junction box, with the intermediate electrical supply wiring passing through and sealed within the second sealed wiring conduit.

* * * * *